US011798470B1

(12) United States Patent
Li et al.

(10) Patent No.: US 11,798,470 B1
(45) Date of Patent: Oct. 24, 2023

(54) PIXEL DRIVING CIRCUIT, DRIVING METHOD FOR PIXEL DRIVING CIRCUIT, AND DISPLAY PANEL

(71) Applicant: HKC CORPORATION LIMITED, Shenzhen (CN)

(72) Inventors: Zeyao Li, Shenzhen (CN); Haijiang Yuan, Shenzhen (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 18/208,266

(22) Filed: Jun. 10, 2023

(30) Foreign Application Priority Data

Nov. 9, 2022 (CN) ..... 202211401507.9

(51) Int. Cl.
*G09G 3/32* (2016.01)

(52) U.S. Cl.
CPC ..... *G09G 3/32* (2013.01); *G09G 2300/0819* (2013.01); *G09G 2300/0852* (2013.01); *G09G 2300/0861* (2013.01); *G09G 2310/08* (2013.01)

(58) Field of Classification Search
CPC ..... G09G 2320/064; G09G 2320/063; G09G 2320/0626
See application file for complete search history.

(56) References Cited

U.S. PATENT DOCUMENTS

2018/0301080 A1 10/2018 Shigeta et al.
2019/0130846 A1* 5/2019 Chung ..... G09G 3/3233
2019/0371231 A1 12/2019 Kim et al.
2022/0114951 A1* 4/2022 Chang ..... G09G 3/14
2023/0121681 A1* 4/2023 Hwang ..... G09G 3/2081 345/55

FOREIGN PATENT DOCUMENTS

CN 108694908 A 10/2018
CN 108735143 A 11/2018
CN 110556072 A 12/2019
(Continued)

OTHER PUBLICATIONS

Chinese First Office Action, Chinese Application No. 202211401507.9, dated Dec. 16, 2022 (31 pages).
(Continued)

*Primary Examiner* — Sepehr Azari

(57) ABSTRACT

A pixel driving circuit, a driving method thereof, and a display panel are provided. The pixel driving circuit includes a light-emitting element, a power line connected to the light-emitting element, a pulse amplitude modulation unit including a first driving transistor connected to the light-emitting element and the power line and configured to provide driving current with different amplitude to the light-emitting element according to voltage applied to a gate of the first driving transistor; and a pulse width modulation unit including a second driving transistor connected to the light-emitting element and the pulse amplitude modulation unit, a first transistor and a second transistor connected to a gate of the second driving transistor, and a pulse width generation circuit connected to the gate of the first transistor. Duration of driving current in the light-emitting element is controlled according to voltage applied to the gate of the second driving transistor.

20 Claims, 8 Drawing Sheets

(56) References Cited

FOREIGN PATENT DOCUMENTS

| | | | |
|---|---|---|---|
| CN | 111369935 | A | 7/2020 |
| CN | 13077750 | A | 7/2021 |
| CN | 113674678 | A | 11/2021 |
| CN | 113707077 | A | 11/2021 |
| CN | 114241976 | A | 3/2022 |
| CN | 114333685 | A | 4/2022 |
| CN | 114694570 | A | 7/2022 |
| CN | 115457907 | A | 12/2022 |
| WO | 2022156079 | A1 | 7/2022 |

OTHER PUBLICATIONS

Chinese second Office Action, Chinese Application No. 202211401507.9, dated Jan. 10, 2023 (10 pages).
Notification to Grant Patent Right for Invention, Chinese Application No. 202211401507.9, dated Feb. 7, 2023 (4 pages).
International Search Report, International Application No. PCT/CN2023/089342, dated Jul. 15, 2023 (16 pages).

* cited by examiner

PIXEL DRIVING CIRCUIT, DRIVING METHOD FOR PIXEL DRIVING CIRCUIT, AND DISPLAY PANEL

CROSS REFERENCE TO RELATED APPLICATIONS

The present disclosure claims priority to Chinese Patent Application No. 202211401507.9 filed with China National Intellectual Property Administration on Nov. 9, 2022, the contents of which is herein incorporated by reference in its entirety.

TECHNICAL FIELD

The present disclosure relates to the field of display panels, in particular to a pixel driving circuit, a driving method for the pixel driving circuit, and a display panel.

BACKGROUND

An inorganic micro light-emitting diode (micro LED) display is one of the hotspots in the field of display research today.

Compared with an OLED display, a micro LED has advantages such as high reliability, low power consumption, high brightness, and fast response speed, etc. A driving circuit configured to control LED to emit light is core technical content of the micro LED display, which has important research significance.

However, since significant difference in light-emitting efficiency of LEDs under different driving current, in order to reduce power consumption of the micro LED display, it is necessary to always enable LED to operate at relatively high current to maintain the LED always operating at a relatively high efficiency range.

SUMMARY

A pixel driving circuit is provided in the present disclosure, and include a light-emitting element, a power line, a pulse amplitude modulation unit, and a pulse width modulation unit. The power line is connected to the light-emitting element. The pulse amplitude modulation unit includes a first driving transistor connected to the light-emitting element and the power line, and configured to provide driving current with different amplitudes to the light-emitting element according to voltage applied to a gate of the first driving transistor. The pulse width modulation unit includes a second driving transistor, a first transistor, a second transistor, and a pulse width generation circuit. The second driving transistor is connected to the light-emitting element and the pulse amplitude modulation unit, a first transistor and a second transistor are connected to a gate of the second driving transistor, and the pulse width generation circuit connected to the gate of the first transistor. A source of the first transistor is connected to a signal line, a drain of the first transistor is connected to a gate of the second driving transistor, and the gate of the first transistor is connected to the pulse width generation circuit. A source of the second transistor is connected to the gate of the first transistor, a drain of the second transistor is connected to the drain of the first transistor and the gate of the second driving transistor, and a gate of the second transistor is connected to a first scan control line. The pulse width generation circuit includes a third transistor, a fourth transistor, and a first capacitor. A source of the third transistor is connected to a reset signal line, a drain of the third transistor is connected to a first electrode plate of the first capacitor and the gate of the first transistor, and the gate of the third transistor is connected to a reset control line. The first electrode plate of the first capacitor is respectively connected to the source of the second transistor, the drain of the third transistor, and the gate of the first transistor. A second electrode plate of the first capacitor is connected to a drain of the fourth transistor. A source of the fourth transistor is connected to a control signal line, the drain of the fourth transistor is connected to the second electrode plate of the first capacitor, and the gate of the fourth transistor is connected to a second scan control line. Duration of driving current in the light-emitting element is controlled by controlling the conduction duration of the second driving transistor according to the first transistor, the second transistor, and the pulse width generation circuit.

A driving method for any one of pixel driving circuits mentioned above is provided. The pulse width modulation unit further includes a first reset transistor, a switch transistor, and a second capacitor; a source of the first reset transistor is connected to a first signal line, a drain of the first reset transistor is connected to the gate of the second driving transistor, and a gate of the first reset transistor is connected to the reset control line; a source of the switch transistor is connected to the drain of the first transistor, a drain of the switch transistor is connected to the gate of the second driving transistor and the drain of the first reset transistor, and a gate of the switch transistor is connected to a switch control line; a first electrode plate of the second capacitor is connected to the power line, and a second electrode plate of the second capacitor is connected to the gate of the second driving transistor, so as to maintain gate voltage of the second driving transistor. The pulse amplitude modulation unit further includes a fifth transistor, a sixth transistor, a second reset transistor, and a third capacitor; a first electrode plate of the third capacitor is connected to the power line, and a second electrode plate of the third capacitor is connected to the gate of the first driving transistor, so as to maintain the gate voltage of the first driving transistor; a source of the fifth transistor is connected to a data line, a drain of the fifth transistor is connected to the source of the first driving transistor, and the gate of the fifth transistor is connected to the first scan control line; a source of the sixth transistor is connected to the drain of the first driving transistor, a drain of the sixth transistor is connected to the gate of the first driving transistor, and the second electrode plate of the third capacitor, and gate of the sixth transistor is connected to the first scan control line; a source of the second reset transistor is connected to the reset signal line, the drain of the second reset transistor is connected to a gate of the first driving transistor and a second electrode plate of the third capacitor, and the gate of the second reset transistor is connected to the reset control line. The driving method includes: in a first stage, the reset control line in a Nth row controls conduction of the third transistor and the second reset transistor, and reset voltage of the reset signal line is transmitted to the gate of the first transistor through the third transistor, and is transmitted to the gate of the first driving transistor through the second reset transistor, so as to enable the first transistor and the first driving transistor to be in an on-state; in a second stage, the first scan control line in the Nth row controls conduction of the second transistor, and second voltage of the signal line is transmitted to the gate of the first transistor through the first transistor and the second transistor to charge the gate of the first transistor; the first scan control line in the Nth row controls conduction of the fifth transistor and the sixth transistor, and data voltage of the data line is transmitted to the gate of the first driving transistor through the fifth transistor, the first driving transistor, and the sixth transistor in order, so as to charge the gate of the first driving transistor; in a third stage, the second scan control line in the Nth row controls conduction of the fourth transistor, and first level voltage of the control signal line is written in the second electrode plate of the first capacitor through the fourth transistor, and transmitted to the gate of the first transistor through coupling effect of the first capacitor; at the same time, the first scan control line controls conduction of the second transistor, thereby enable the gate and drain of the first transistor to be connected to each other to maintain gate voltage of the first transistor; in a fourth stage, the control line in the Nth row controls conduction of the first reset transistor, and first voltage of the first signal line is transmitted to the gate of the second driving transistor and the second electrode plate of the second capacitor through the first reset transistor, and is maintained through the second capacitor; the second scan control line in the Nth row controls conduction of the fourth transistor, and the second level voltage of the control signal line is written in the second electrode plate of the first capacitor through the fourth transistor, and transmitted to the gate of the first transistor through the coupling effect of the first capacitor to implement writing of width data; in a fifth stage, the second scan control line in all rows controls conduction of the fourth transistor, and swing voltage of the control signal line is transmitted to the gate of the first transistor through the fourth transistor and the first capacitor to control conduction of the first transistor; at the same time, the switch control lines in all rows control conduction of the switch transistor, and the second voltage of the signal line is transmitted to the gate of the second driving transistor through the first transistor and the switch transistor to control conduction of the second driving transistor.

A display panel is provided and includes a plurality of pixel units arranged in an array, and each pixel unit is provided with any one of pixel driving circuits mentioned above.

BRIEF DESCRIPTION OF THE DRAWINGS

In order to make the technical solution described in embodiments of the present disclosure more clearly, the drawings used for description of embodiments or background will be described. Apparently, the drawings in the following description are only some embodiments of the present disclosure. For those skilled in the art, other drawings may be acquired according to the drawings without any creative work.

Figure 1:
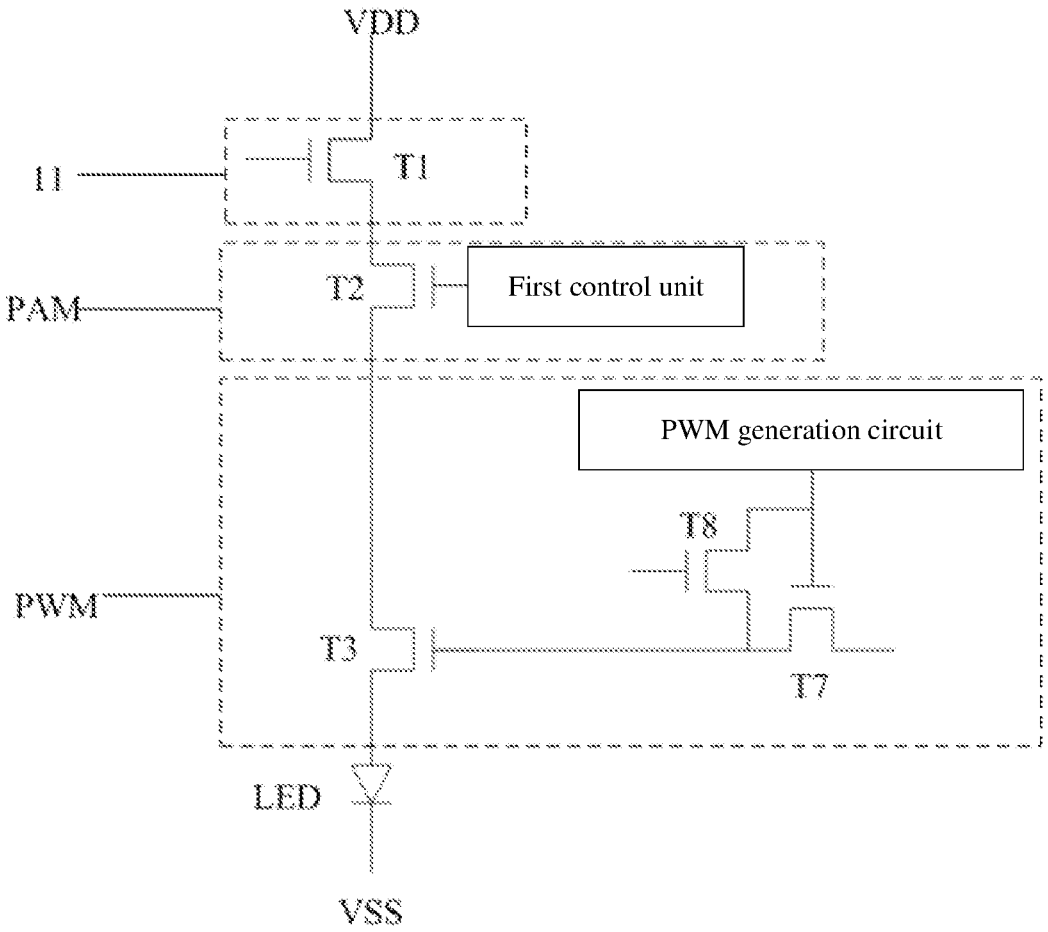
FIG. 1 is a schematic diagram of a framework structure of an embodiment of a pixel driving circuit of the present disclosure.

LED: light-emitting element; VDD: power line/high potential power line; PAM: pulse amplitude modulation unit; PWM: pulse width modulation unit; VSS: low potential power line; 11: control unit; T1: first switch transistor; T2: first driving transistor; T3: second driving transistor; T5: first reset transistor; T6: switch transistor; T4: reset transistor; T7: first transistor; T8: second transistor; T9: third transistor; T10: fourth transistor; C1: first capacitor; C2: second capacitor; T11: fifth transistor; T12: sixth transistor; T13: second reset transistor; C1: third capacitor; 1: control line; gh1: first signal line; int: reset signal line; reset: reset control line; gh2: signal line; a: control signal line; scan1: first scan control line; scan2: second scan control line; data: data line; EM: switch control line; T14: second switch transistor; 110: pixel unit.

DETAILED DESCRIPTION

The technical solutions in embodiments of the present disclosure are clearly and completely described in conjunction with the drawings in the embodiments of the present disclosure. It is obvious that the described embodiments are only a part of embodiments of the present disclosure, and not all embodiments. All other embodiments acquired by those skilled in the art based on the embodiments in the present disclosure without the creative work are all within the scope of the present disclosure.

The terms used in embodiments of the present disclosure are only for the purpose of describing specific embodiments, and are not intended to limit the present disclosure. The singular forms of "a/an" and "the" used in embodiments of the present disclosure and the accompanying claims are also intended to include the plural form, unless other meanings are clearly stated above. "a plurality of" generally includes at least two, but does not exclude at least one.

The term "and/or" in the present disclosure is only an association relationship describing the associated objects, which means that there can be three kinds of relationships; for example, A and/or B can mean three situations including: A exists alone, A and B exist simultaneously, and B exists alone. In addition, the character "/" in the present disclosure generally indicates that associated objects before and after this character are in an "or" relationship. The terms "first", "second", etc. in the description, claims, and the accompanying drawings of the present disclosure are used to distinguish similar objects, without necessarily describing a specific order or an order.

It should be understood that the terms "include", "contain", or any other changes used in the present disclosure are intended to cover non-exclusive inclusion, so that a process, a method, a product, or device that includes a series of elements not only includes the elements, but also other elements that are not explicitly listed, or also includes inherent elements of the process, the method, the product, or the device. In case where there are no further limitations, elements limited by the statement "include . . . " do not exclude existence of other identical elements in the process, the method, the product, or the device that includes the elements.

It should be noted that when directional indications (such as up, down, left, right, front, back . . . ) are used in embodiments of the present disclosure, the directional indications are only used to explain relative position relationship, motion situation, etc. between components in a specific posture (as shown in the drawings). When the specific posture changes, the directional indication also changes accordingly.

"Embodiments" in the present disclosure means that specific features, structures, or characteristics described in conjunction with embodiments may be included in at least one embodiment of the present disclosure. The term appearing in various positions of the description does not necessarily refer to a same embodiment, and does not necessarily refer to an independent or alternative embodiment that is mutually exclusive with other embodiments. Those skilled explicitly and implicitly understand that the embodiments described in the present disclosure can be combined with other embodiments.

The present disclosure provides a pixel driving circuit. Referring to FIG. 1 for details, FIG. 1 is a schematic diagram of a framework structure of an embodiment of a pixel driving circuit of the present disclosure. As shown in FIG. 1, the pixel driving circuit includes a light-emitting element LED, a power line VDD, a pulse amplitude modulation unit PAM, and a pulse width modulation unit PWM.

The power line VDD includes a high potential power line VDD and a low potential power line VSS. The current flows through the light-emitting element LED through the high potential power line VDD, and then flows to the low potential power line VSS. The low potential power line VSS may be grounded, which is not limited here. In embodiments of the present disclosure, the power line is the high potential power line VDD.

The light-emitting element LED is a light-emitting diode or an organic light-emitting diode.

In some embodiments, the power line VDD is sequentially connected to the pulse amplitude modulation unit PAM, the pulse width modulation unit PWM, and the light-emitting element LED. That is to say, current flows through the pulse amplitude modulation unit PAM and the pulse width modulation unit PWM and flows to the light-emitting element LED through the high potential power line VDD. In other embodiments, order of the pulse amplitude modulation unit PAM and the pulse width modulation unit PWM may be changed. which is not limited here.

The pulse amplitude modulation unit PAM includes a first driving transistor T2. A source of the first driving transistor T2 is connected to the power line VDD, a drain of the first driving transistor T2 is connected to the light-emitting element LED through a second driving transistor T3 of the pulse width modulation unit PWM, and a gate of the first driving transistor T2 is connected to a first control unit. The pulse amplitude modulation unit PWM controls voltage applied to the gate of the first driving transistor T2 to provide driving current with different amplitudes to the light-emitting element LED.

In some embodiments, the pulse width modulation unit PWM includes the second driving transistor T3 connected to the light-emitting element LED and the pulse amplitude modulation unit PAM, a first transistor T7 and a second transistor T8 connected to a gate of the second driving transistor T3, and a pulse width generation circuit (PWM generation circuit) connected to a gate of the first transistor T7.

A source of the first transistor T7 is connected to a signal line gh2, a drain of the first transistor T7 is connected to the gate of the second driving transistor T3, and the gate of the first transistor T7 is connected to the PWM generation circuit. A source of the second transistor T8 is connected to the gate of the first transistor T7, a drain of the second transistor T8 is connected to the drain of the first transistor T7 and the gate of the second driving transistor T3, and a gate of the second transistor T8 is connected to a first scanning control line scan1.

The pulse width modulation unit PWM controls duration of conduction voltage of the gate of the second driving transistor T3 based on the first transistor T7, the second transistor T8, and the PWM generation circuit, thereby controlling duration of driving current in the light-emitting element LED, i.e., light-emitting duration of the light-emitting element LED.

The technical effect in embodiments of the present disclosure is as following. The gate and drain of the first transistor T7 are respectively connected to the source and drain of the second transistor T8, such that internal compensation for the gate voltage of the first transistor T7 is implemented, thereby eliminating influence of threshold voltage of the gate of the first transistor on the second driving transistor T8.

In some embodiments, the pixel driving circuit includes a control unit 11 connected between the light-emitting element LED and the power line VDD to control on/off of the light-emitting element LED. In some embodiments, the control unit 11 is arranged between the power line VDD and the pulse amplitude modulation unit PAM. In other embodiments, the control unit 11 may also be arranged on other positions, for example, the control unit 11 may be arranged between the pulse width modulation unit PWM and the light-emitting element LED, or between the pulse amplitude modulation unit PWM and the pulse amplitude modulation unit PAM, which is not limited here. In other embodiments, the control unit 11 may not be arranged or may be replaced with other components. The arrangement and position of control unit 11 may be adjusted according to an actual situation, which is not limited here.

In some embodiments, the control unit 11 includes a first switch transistor T1, which is turned on or off to implement functions of the control unit 11. A source of the first switch transistor T1 is connected to the power line VDD, a drain of the first switch transistor T1 is connected to the source of the first driving transistor T2, and a gate of the first switch transistor T1 is connected to a switch control line EM. In some embodiments, the first switch transistor T1 may also control on/off between the power line VDD and the first driving transistor T2, which may also be implemented through other transistor circuits in other embodiments, which is not limited here.

In some embodiments, the control unit 11 includes a second switch transistor T14. a source of the second switch transistor T14 is connected to the drain of the second driving transistor T3, and a drain of the second switch transistor T14 is connected to the light-emitting element LED, so as to control on/off between the second driving transistor T3 and the light-emitting element LED.

It should be noted that it may be considered that gates of various transistors in embodiments the present disclosure may be connected to different control lines to implement on/off of the various transistors, respectively. However, in order to reduce arrangement of lines, a same control line is configured for a plurality of transistors that need to be conducted simultaneously. For example, the first switch transistor T1, the second switch transistor T14, and switch transistor T6 are configured with a same control line.

Figure 2:
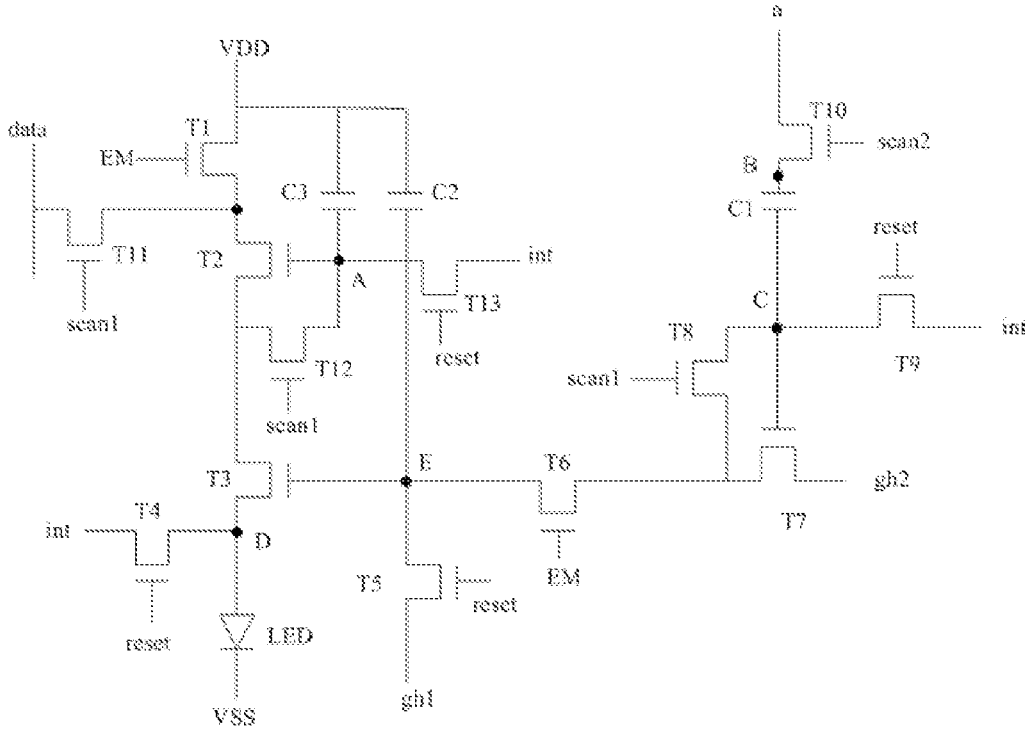
FIG. 2 is a structural schematic diagram of a first embodiment of a pixel driving circuit of the present disclosure.

In some embodiments, the pixel driving circuit includes a reset circuit, which is not shown in FIG. 1, and is referred to a structure in embodiments below for details. The reset circuit is connected to an anode of the light-emitting element LED to ensure that the anode of the light-emitting element LED has same level voltage each time the light-emitting element LED emits light. In some embodiments, the reset circuit is arranged between the pulse width modulation unit PWM and the light-emitting element LED, which may be arranged based on an actual circuit in other embodiments, and is not limited here. As shown in FIG. 2, the reset circuit includes a reset transistor T4. A source of the reset transistor T4 is connected to a reset signal line int, a drain of the reset transistor T4 is connected to the anode of the light-emitting element LED, and a gate of the reset transistor T4 is connected to a reset control line reset. In other embodiments, the reset transistor T4 may not be arranged, which is not limited here.

The technical effects of embodiments of the present disclosure also includes as following. The driving current and light-emitting duration of the light-emitting element LED are respectively controlled by the first driving transistor T2 and the second driving transistor T3, such that controlling the driving current and the light-emitting duration of the light-emitting element are controlled by respectively controlling the gate voltage of the first transistor T7 and the second transistor T8, which is easy to control and adjust.

The present disclosure also provides a specific circuit structure of a first pixel driving circuit, as shown in FIG. 2, FIG. 2 is a structural schematic diagram of a first embodiment of a pixel driving circuit of the present disclosure. As shown in FIG. 2, the pulse width modulation unit PWM specifically includes the second driving transistor T3, a first reset transistor T5, the switch transistor T6, the first transistor T7, a second transistor T8, a third transistor T9, a fourth transistor T10, and a first capacitor C1.

The source of the first transistor T7 is connected to the signal line gh2, the drain of the first transistor T7 is connected to a drain of the second transistor T8 and a source of the switch transistor T6, and a gate of the first transistor T7 is connected to a first electrode plate of the first capacitor C1 and a source of the second transistor T8.

A source of the second transistor T8 is connected to the first electrode plate of the first capacitor C1 and a drain of the third transistor T9. The drain of the second transistor T8 is connected to a drain of the first transistor T7 and the source of the switch transistor T6, and a gate of the second transistor T8 is connected to a first scan control line scan1.

A source of the third transistor T9 is connected to the reset signal line int. The drain of the third transistor T9 is connected to the first electrode plate of the first capacitor C1, the gate of the first transistor T7, and the source of the second transistor T8. A gate of the third transistor T9 is connected to the reset control line reset.

The first electrode plate of the first capacitor C1 is connected to the gate of the first transistor T7, the source of the second transistor T8, and the drain of the third transistor T9. The second electrode plate of the first capacitor C1 is connected to a drain of the fourth transistor T10.

A source of the fourth transistor T10 is connected to a control signal line a, the drain of the fourth transistor T10 is connected to the second electrode plate of the first capacitor C1, and a gate of the fourth transistor T10 is connected to a second scan control line scan2.

In some embodiments, the pulse width modulation unit PWM includes a second capacitor C2. A first electrode plate of the second capacitor C2 is connected to the power line VDD, a second electrode plate of the second capacitor C2 is connected to the gate of the second driving transistor T3, the drain of the first reset transistor T5, and the drain of the switch transistor T6 to maintain voltage applied to the gate of the second driving transistor T3 by the first reset transistor T5.

In some embodiments, the amplitude modulation unit PAM includes the first driving transistor T2, a fifth transistor T11, a sixth transistor T12, a second reset transistor T13, and a third capacitor C3.

A source of the fifth transistor T11 is connected to a data line data, the drain of the fifth transistor T11 is connected to a source of the first driving transistor T2, and a gate of the fifth transistor T11 is connected to the first scan control line scan1.

A source of the sixth transistor T12 is connected to the source of the second driving transistor T3. The drain of the sixth transistor T12 is connected to the gate of the first driving transistor T2, a second electrode plate of the third capacitor C3, and a drain of the second reset transistor T13. A gate of the sixth transistor T12 is connected to the first scan control line scan1.

A source of the second reset transistor T13 is connected to the reset signal line int, the drain of the second reset transistor T13 is connected to the gate of the first driving transistor T2 and the second electrode plate of the third capacitor C3, and a gate of the second reset transistor T13 is connected to the reset control line reset.

In some embodiments, the drain and gate of the first driving transistor T2 are respectively connected to the source and drain of the sixth transistor T12, such that the pulse amplitude modulation unit PAM controls conduction of the sixth transistor T12 to compensate for the gate voltage of the first driving transistor T2, enable the first driving transistor T2 to reach opening voltage and implement internal compensation. In other embodiments, the gate of the first driving transistor T2 may also be directly controlled through external lines to implement the external compensation. That is to say, the pulse amplitude modulation unit PAM may also implement compensation through other circuit structures, which is not limited here.

In some embodiments, the pixel driving circuit includes the first switch transistor T1. The source of the first switch transistor T1 is connected to the power line VDD, the drain of the first switch transistor T1 is connected to the source of the first driving transistor T2, and the gate is connected to the switch control line EM, so as to implement the functions of the control unit, and control the on/off of the light-emitting element LED by controlling the conduction of the first switch transistor T1. In other embodiments, the arrangement and position of the first switch transistor T1 may be arranged according to an actual situation, which is not limited here.

In some embodiments, the pixel driving circuit includes the reset transistor T4. The source of the reset transistor T4 is connected to the reset signal line int, the drain of the reset transistor T4 is connected to the anode of the light-emitting element LED, and the gate of the reset transistor T4 is connected to the reset control line reset. Enabling the anode of the light-emitting element LED to have same voltage before emitting light each time ensures that the light-emitting element LED has same level voltage before emitting light, so that the light-emitting element LED has the same brightness under same voltage modulation, thereby avoiding the uncontrolled brightness of the light-emitting element LED. In other embodiments, the reset transistor T4 may not be arranged, which is not limited here.

The first switch transistor T1, the first driving transistor T2, the second driving transistor T3, the reset transistor T4, the first reset transistor T5, the switch transistor T6, the first transistor T7, the second transistor T8, the third transistor T9, the fourth transistor T10, the fifth transistor T11, the sixth transistor T12, and the second reset transistor T13 are all P-type transistors with low potential conduction. In other embodiments, the first switch transistor T1, the first driving transistor T2, the second driving transistor T3, the reset transistor T4, the first reset transistor T5, the switch transistor T6, the first transistor T7, the second transistor T8, the third transistor T9, the fourth transistor T10, the fifth transistor T11, the sixth transistor T12, and the second reset transistor T13 may all be N-type transistors with high potential conduction. In other embodiments, the pixel driving circuit may also be hybrid drive circuits with some P-type transistors and some N-type transistors, which is not limited here.

Figure 3:
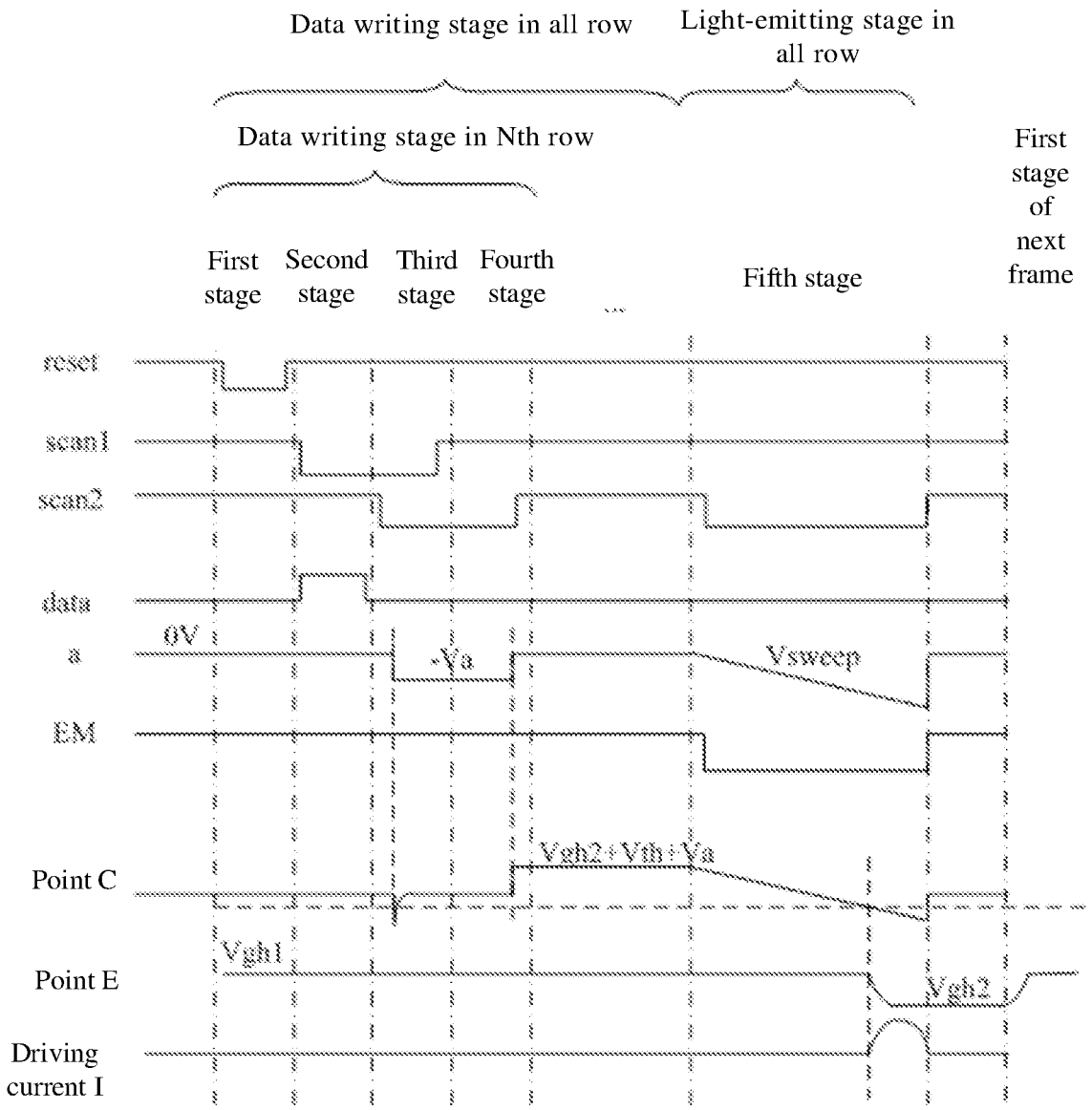
FIG. 3 is a driving signal time sequence diagram of a first driving method for pixel driving circuit according to some embodiments of the present disclosure.

The present disclosure also provides a driving method based on the structure of the first embodiment of the pixel driving circuit. Referring to FIG. 3 for details, FIG. 3 is a driving signal time sequence diagram of a first driving method for pixel driving circuit according to some embodiments of the present disclosure. As shown in FIG. 3, the driving method includes: a first stage, a second stage, a third stage, a fourth stage, and a fifth stage. The fifth stage is an emitting-light stage, and the first to fourth stages are the data writing stage for all transistors in each row. In other embodiments, the data may also be written in columns, which is not limited. In some embodiments, the driving method is described by taking the first switch transistor T1, the first driving transistor T2, the second driving transistor T3, the reset transistor T4, the first reset transistor T5, the switch transistor T6, the first transistor T7, the second transistor T8, the third transistor T9, the fourth transistor T10, the fifth transistor T11, the sixth transistor T12, and the second reset transistor T13 being P-type transistors with low potential conduction as examples.

In the first stage, the reset control line reset in a Nth row controls the conduction of the third transistor T9 and the second reset transistor T13. Reset voltage $V_{int}$ of the reset signal line int is transmitted to the gate of the first transistor T7 and the first plate of the first capacitor C1 through the third transistor T9, and is maintained through the first capacitor C1. The reset voltage $V_{int}$ of the reset signal line int is transmitted to the gate of the first driving transistor T2 and the second electrode plate of the third capacitor C3 through the second reset transistor T13, and is maintained through the third capacitor C3. The reset voltage $V_{int}$ may be 0 potential voltage, thereby discharging the anode of the LED, restoring the voltage of the light-emitting element LED to potential 0, and preventing the light-emitting element LED from emitting light in the first stage, which is not limited here. The reset voltage $V_{int}$ of the reset signal line int is less than the emitting-light voltage of the light-emitting element LED, so that the light-emitting element LED does not emit light. In some embodiments, the reset voltage $V_{int}$ reaches the opening voltage of the first transistor T7 and the first driving transistor T2, thereby enabling the first transistor T7 and the first driving transistor T2 to be in an on-state in the first stage. However, since the other transistors are in an off-state, path is not formed. By enabling the first transistor T7 and the first driving transistor T2 to be in the on-state in the first stage, it is convenient to charge the gates of the first transistor T7 and the first driving transistor T2 in the second stage.

Figure 4:
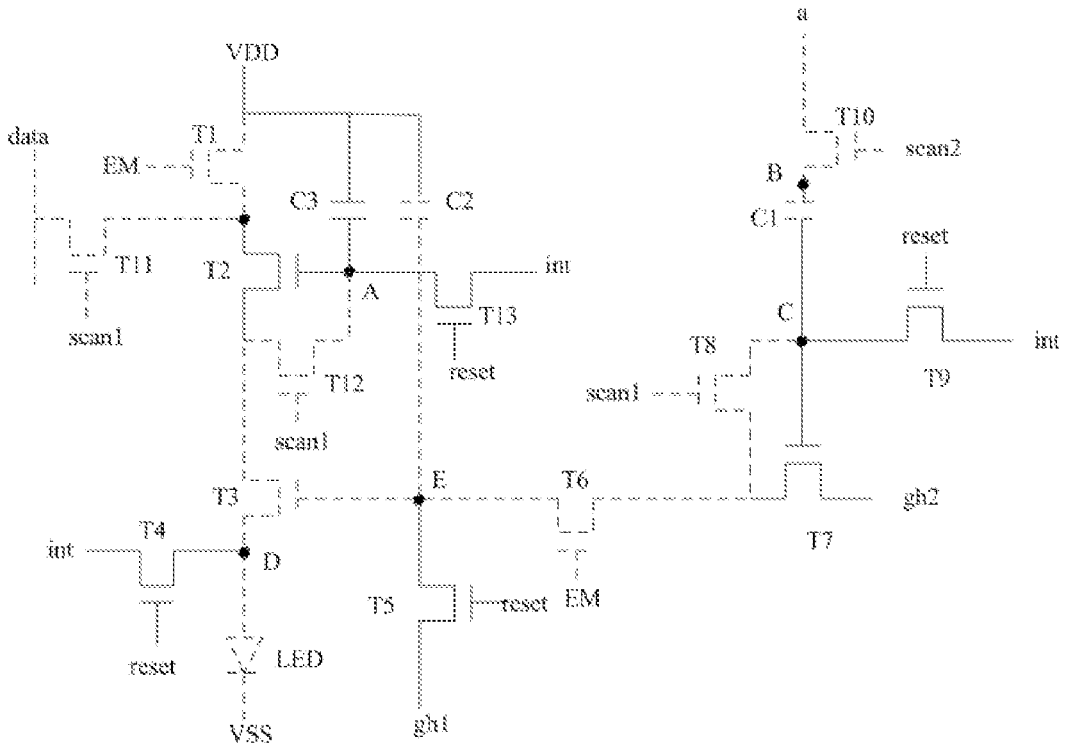
FIG. 4 is an equivalent circuit pattern of the first driving method as shown in FIG. 3 in a first stage.

Referring to FIG. 4, FIG. 4 is an equivalent circuit pattern of the first driving method as shown in FIG. 3 in a first stage. As shown in FIG. 4, in the first stage, the third transistor T9 and the second reset transistor T13 are conductive. Voltage at points A and C are both the reset voltages $V_{int}$, and the voltage at point A and point C are maintained through the third capacitor C3 and the first capacitor C1, respectively. At this time, the light-emitting element LED does not emit light.

In some embodiment, in the first stage, the reset control line reset also controls the conduction of the reset transistor T4 to write the reset voltage $V_{int}$ of the reset signal line int to the anode of the light-emitting element LED, thereby enabling the voltage of the light-emitting element LED to return to $V_{int}$. Specifically, the reset transistor T4 is conducted between the reset signal line int and the anode of the light-emitting element LED, thereby enabling the light-emitting element LED to discharge/charge, and return to $V_{int}$. As shown in FIG. 4, the voltage at point D is also $V_{int}$, and in an ideal state, the voltage at point C remains unchanged from the first to fourth stages.

In some embodiment, the reset control line reset also controls the conduction of the first reset transistor T5 to write first voltage $V_{gh1}$ of the first signal line gh1 to the gate of the second driving transistor T3, controls the breaking of the second driving transistor T3, and maintains the second driving transistor T3 in an off-state in the first, second, third, and fourth stages. Specifically, the off-state of the second driving transistor T3 is maintained through the second capacitor C2. At the beginning of the first stage, the reset control line reset in the Nth row inputs low-level voltage to control the conduction of the first reset transistor T5. The first voltage $V_{gh1}$ of the first signal line gh1 is transmitted to the gate of the second driving transistor T3 and the second electrode plate of the second capacitor C2 through the first reset transistor T5, and is maintained through the second electrode plate of the second capacitor C2. At this time, the voltage at point E reaches $V_{gh1}$. The $V_{gh1}$ is greater than threshold voltage of the second driving transistor T3, thereby enabling the second driving transistor T3 not to be conductive.

In some embodiments, the gate of the second driving transistor T3 is connected to the second electrode plate of the second capacitor C2. When voltage $V_{gh1}$ is charged with the gate of the second driving transistor T3, the voltage $V_{gh1}$ is maintained by the second electrode plate of the second capacitor C2. In other embodiments, the second capacitor C2 is not arranged, in an ideal state (without considering discharge loss), the g voltage $V_{gh1}$ may also remain unchanged after charged with the $V_{gh1}$ voltage. Therefore, in other embodiments, the second capacitor C2 may not be arranged, $V_{gh1}$ should be a positive value to ensure that the second driving transistor T3 is not conductive. $V_{gh1}$ is initial voltage of the second driving transistor T3. In the fifth stage, after the signal line gh2 is conducted, the gate voltage of the second driving transistor T3 slowly decreases until it reaches $V_{gh2}$, and then remains unchanged.

In the second stage, the first scan control line scan1 in the Nth row controls the conduction of the fifth transistor T11 and the sixth transistor T12. The data voltage $V_{data}$ of the data line data is transmitted to the gate of the first driving transistor T2 through the fifth transistor T11, the first driving transistor T2, and the sixth transistor T12 in order, so as to charge the gate of the first driving transistor T2, enable the gate voltage of the first driving transistor T2 reach the opening voltage of the first driving transistor T2, and maintain the opening voltage through the third capacitor C3. The first scan control line scan1 in the Nth row also controls the conduction of the second transistor T8, so that the second voltage $V_{gh2}$ of the signal line gh2 is transmitted to the gate of the first transistor T7 through the first transistor T7 and the second transistor T8 in order, so as to charge the gate of the first transistor T7, enable the gate voltage of the first transistor T7 to reach the opening voltage, and maintain the opening voltage through the first capacitor C1.

Figure 5:
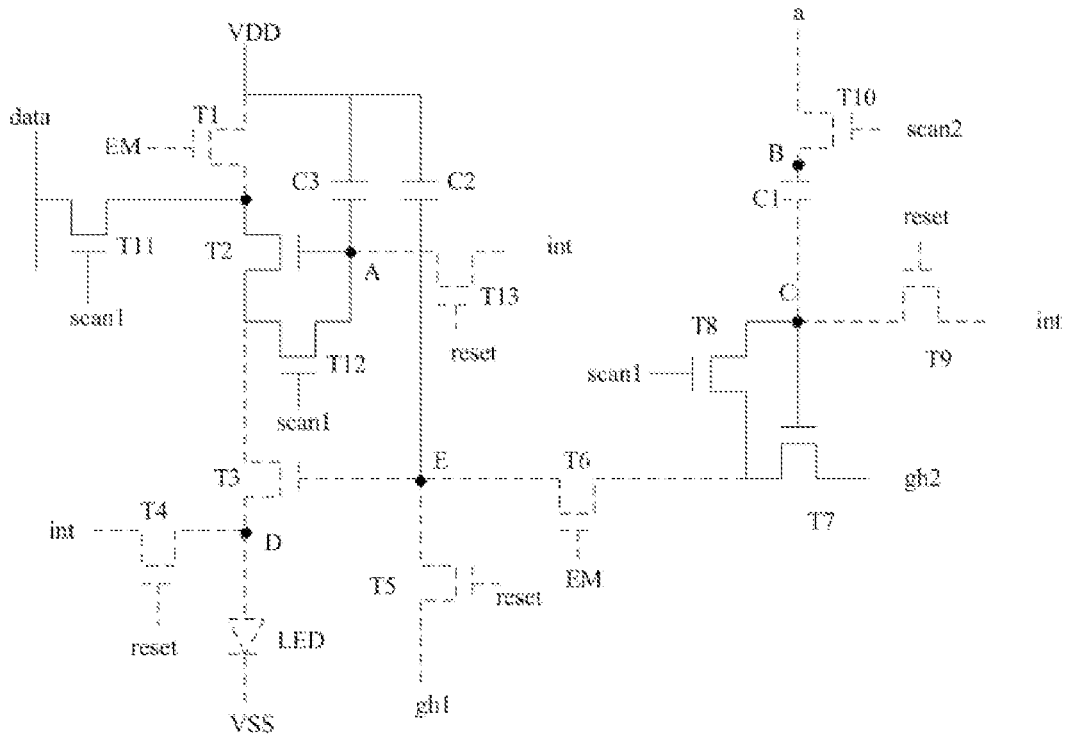
FIG. 5 is an equivalent circuit pattern of the first driving method as shown in FIG. 3 in a second stage.

Referring to FIG. 5 for details, FIG. 5 is an equivalent circuit pattern of the first driving method as shown in FIG. 3 in a second stage. As shown in FIG. 5, the first scan control line scan1 inputs a low-level voltage to control the conduction of the fifth transistor T11 and the sixth transistor T12. The data voltage $V_{data}$ writes voltage in the gate of the second driving transistor T3, and compensates for the threshold voltage $V_{th}$ of the first driving transistor T2, thereby enabling the voltage at point A to become $V_{data}+V_{th}$, that is, the gate voltage Vg of the first driving transistor T2 reaches $V_{data}+V_{th}$. At this time, gate-source voltage of the first driving transistor T2 is $V_{gs}=V_g-V_s=V_{th}$, the first driving transistor T2 is broken, and the gate of the first driving transistor T2 is stopped charged. Since the fact that working current of the first driving transistor T2 is $I=KW/L(V_{gs}-V_{th})^2$, K is amplification coefficient of a thin-film transistor (TFT) component and is a constant, $V_{gs}$ is the gate-source voltage, $V_{th}$ is threshold voltage of a transistor.

In some embodiments, since the first driving transistor T2 is a P-type transistor, the gate-source voltage $V_{gs}$ of the first driving transistor T2 should be less than the threshold voltage $V_{th}$ of the first driving transistor T2. When the T2 gate voltage is charged to $V_{data}+V_{th}$, the first driving transistor T2 is broken, the gate of the first driving transistor T2 is stopped charged, and the gate voltage of the first driving transistor T2 reaches saturation.

In the light-emitting stage, since the source voltage of the first driving transistor T2 changing to Vim which is voltage provided by the power line VDD, at this time, the gate-source voltage $V_{gs}=V_{data}+V_{th}-V_{dd}$ is less than $V_{th}$, and the first driving transistor T2 is conductive, $V_{gs}-V_{th}=V_{data}-V_{dd}$, the working current of the first driving transistor T2 is independent of the threshold voltage $V_{th}$ of the first driving transistor T2. In some embodiments, the first driving transistor T2 is compensated through the first reset transistor T5 and the switch transistor T6, thereby eliminating the influence of the threshold voltage of the first driving transistor T2 on the driving current, thereby implementing compensation for the gate of the driving transistor T2.

Similarly, the first scan control line scan1 controls the conduction of the second transistor T8, and the second voltage $V_{gh2}$ writes voltage in the gate of the first transistor T7, thereby enabling the gate voltage $V_g$ of the first transistor T7 to reach $V_{gh2}+V_{th}$ and the voltage at point C to become $V_{gh2}+V_{th}$, and implementing compensation for the gate voltage of the first transistor T7 to eliminate the influence of the threshold voltage $V_{th}$ of the first transistor T7. Threshold voltage of transistors in a same pixel is similar. In some embodiments, it is considered that the threshold voltage of the first transistor T7 is the same as the voltage of the first driving transistor T2, and the threshold voltage $V_{th}$ is not distinguished here. In other embodiments, the fifth transistor T11 and sixth transistor T12 may also be controlled to be conducted in other stages by other control lines, for example, the fifth transistor T11 and sixth transistor T12 are conducted in the third stage to charge the gate of the first driving transistor T2, which is not limited here.

In the third stage, the second scan control line scan2 in the Nth row controls the conduction of the fourth transistor T10, and the first level voltage $-V_a$ of a control signal line a is written in the second electrode plate of the first capacitor C1 through the fourth transistor T10, and transmitted to the first electrode plate of the first capacitor C1, that is, the gate of the first transistor T7, through coupling effect of the first capacitor C1. At the same time, the first scan control line scan1 controls the conduction of the second transistor T8, and enable the gate voltage of the first transistor T7 to fall back to $V_{gh2}+V_{th}$ through the second transistor T8 and the first transistor T7, thereby maintaining the gate voltage of the first transistor T7.

Figure 6:
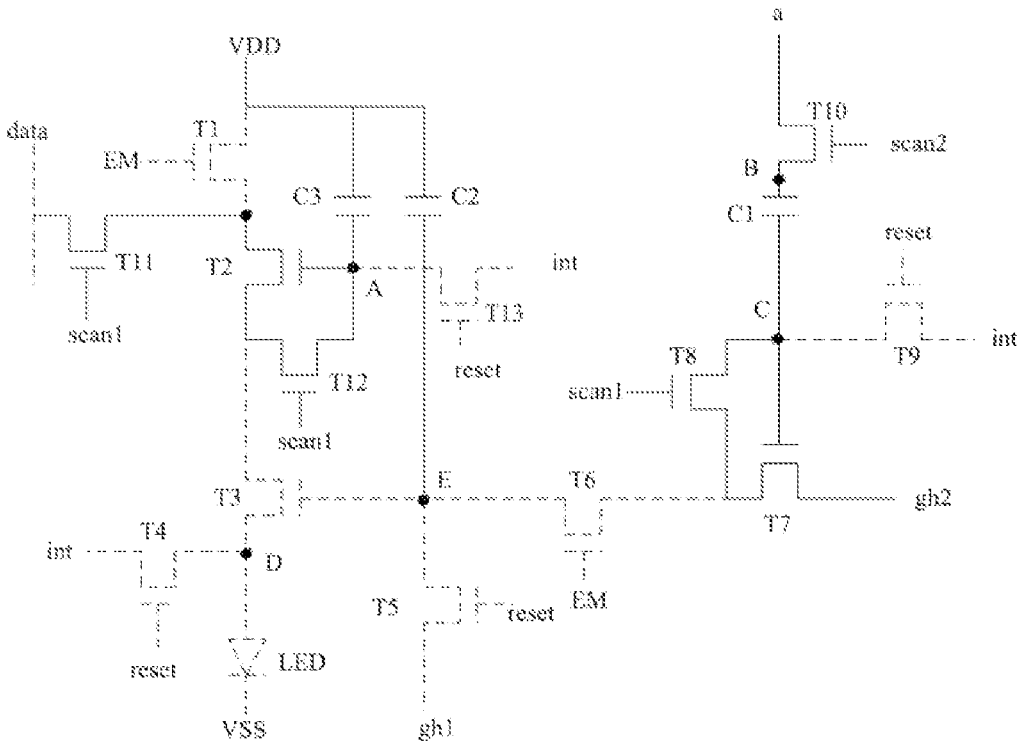
FIG. 6 is an equivalent circuit pattern of the first driving method as shown in FIG. 3 in a third stage.

Referring to FIG. 6 for details, FIG. 6 is an equivalent circuit pattern of the first driving method as shown in FIG. 3 in a third stage. As shown in FIG. 6, the second scan control line scan2 in the Nth row inputs low-level voltage in the third stage to control the conduction of the fourth transistor T10. At this time, the level voltage at point B changes from 0 to $-V_a$, and the voltage at point C is coupled to $V_{gh2}+V_{th}-V_a$ through coupling effect of the first capacitor C1. At the same time, in the third stage, the first scan control line scan1 inputs the low-level voltage to control the second transistor T8 to be in an on-state. In the on-state of the second transistor T8, the second transistor T8 discharges through the signal line gh2, thereby enabling the voltage at point C to quickly fall back to $V_{gh2}+V_{th}$.

In some embodiments, the fifth transistor T11 and sixth transistor T12 share a control signal line with the second transistor T8. Therefore, in the third stage, the fifth transistor T11 and sixth transistor T12 are also in an on-state, but the gate of the second driving transistor T3 is not charged, that is, the gate voltage of the second driving transistor T3 is maintained unchanged.

In the fourth stage, the second scan control line scan2 in the Nth row continues to control the conduction of the fourth transistor T10. The second level voltage 0V of the control signal line a is written in the second electrode plate of the first capacitor C1 through the fourth transistor T10, and is transmitted to the gate of the first transistor T7 through the coupling effect of the first capacitor C1, thereby implementing the writing of width data.

In other embodiments, the first reset transistor T5 may also be controlled by a control line 1, and the control line 1 in the Nth row may also control the conduction of the first reset transistor T5 in the fourth stage, and may also control the conduction of the first reset transistor T5 in the first, second, and third stages, which is not limited. The first voltage $V_{gh1}$ of the first signal line gh1 is transmitted to the gate of the second driving transistor T3 and the second electrode plate of the second capacitor C2 through the first reset transistor T5, and is maintained through the second electrode plate of the second capacitor C2, so that initial voltage of the second driving transistor T3 is $V_{gh1}$ and remains an off-state.

Figure 7:
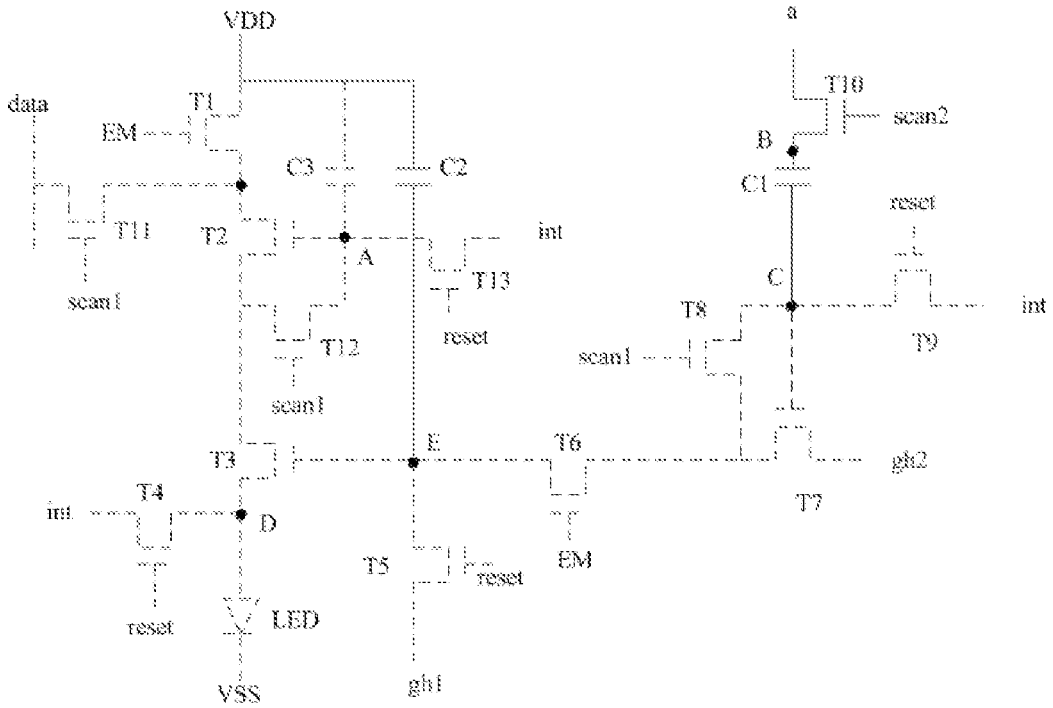
FIG. 7 is an equivalent circuit pattern of the first driving method as shown in FIG. 3 in a fourth stage.

Referring to FIG. 7, FIG. 7 is an equivalent circuit pattern of the first driving method as shown in FIG. 3 in a fourth stage. Combining FIGS. 3 and 7, it may be seen that at the end of the fourth stage, the second level voltage 0V of the control signal line a is written in the second electrode plate of the first capacitor C1 through the fourth transistor T10, and transmitted to the gate of the first transistor T7 through the coupling effect of the first capacitor C1, so that the gate voltage of the first transistor T7 reaches $V_{gh2}+V_{th}+V_a$, that is, the voltage at point C reaches $V_{gh2}+V_{th}+V_a$. Since the second transistor T8 is in an off-state, the gate voltage of the first transistor T7 reaches $V_{gh2}+V_{th}+V_a$ and remains unchanged, $V_{gh2}+V_{th}+V_a$ is greater than the voltage of the first transistor T7, thereby enabling the first transistor T7 to not be conducted.

In the fifth stage, the second scan control lines scan2 in all rows control the conduction of the fourth transistor T10, and swing voltage $V_{sweep}$ of the control signal line a is transmitted to the gate of the first transistor T7 through the fourth transistor T10 and the first capacitor C1 to control the conduction of the first transistor T7. At the same time, switch control lines EM in all rows control the conduction of switch transistor T6, and second voltage $V_{gh2}$ of signal line gh2 is transmitted to the gate of the second driving transistor T3 through the first transistor T7 and switch transistor T6, thereby controlling the conduction of the second driving transistor T3.

In some embodiments, in the fifth stage, the switch control lines EM in all rows also control the conduction of the first switch transistor T1, thereby enabling a circuit from the power line VDD to the light-emitting element LED to be conducted, and enabling the light-emitting element LED to emit light in the fifth stage.

Figure 8:
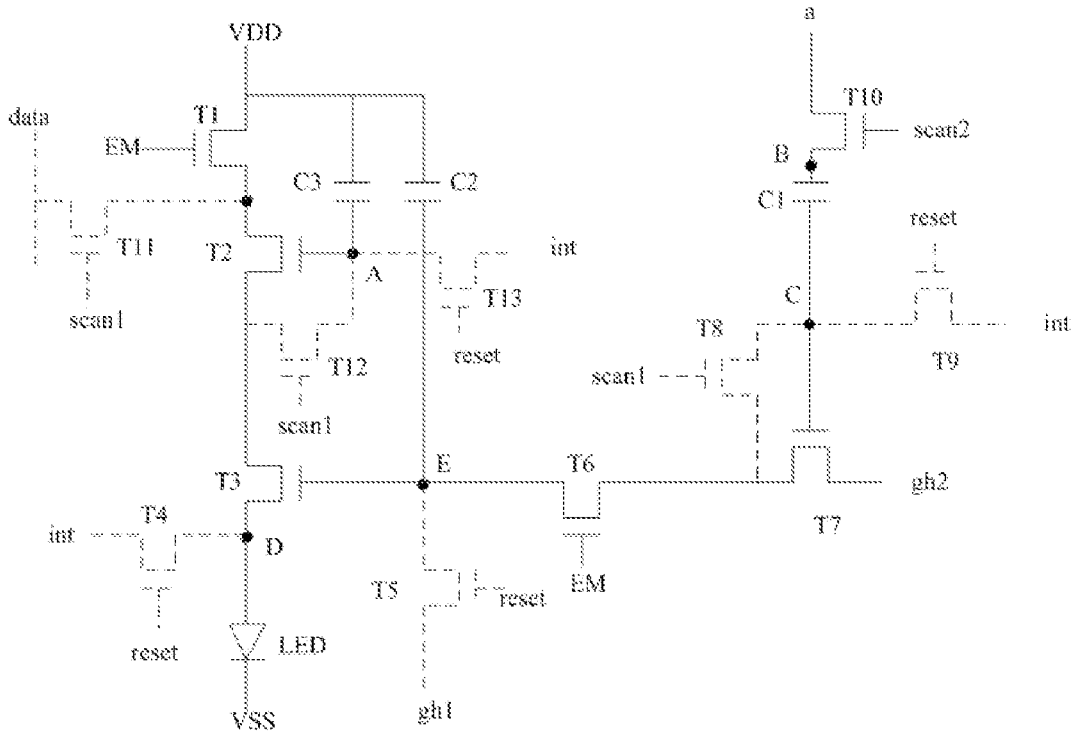
FIG. 8 is an equivalent circuit pattern of the first driving method as shown in FIG. 3 in a fifth stage.

Referring to FIG. 8 for details, FIG. 8 is an equivalent circuit pattern of the first driving method as shown in FIG. 3 in a fifth stage. Combining FIGS. 3 and 8, it may be seen that the fourth transistor T10 is conducted, and the swing voltage $V_{sweep}$ of the control signal line a is transmitted to the gate of the first transistor T7 through the fourth transistor T10 and the first capacitor C1. When the swing voltage $V_{sweep}$ decreases to a certain extent, that is, opening voltage ($V_{th}$) of the first transistor T7, the first transistor T7 is conducted. At this time, the second voltage $V_{gh2}$ of the signal line gh2 is transmitted to the gate of the second driving transistor T3 through the first transistor T7 and the switch transistor T6, enabling the gate voltage of the second driving transistor T3 to decrease from $V_{gh1}$ to $V_{gh2}$, thereby implementing the conduction of the second driving transistor T3. $V_{gh2}$ is less than the threshold voltage of the second driving transistor T3, so that the P-type second driving transistor T3 may be conducted.

In some embodiments, the first transistor T7 is a P-type transistor, and the swing voltage $V_{sweep}$ is a uniformly decreasing voltage. The swing voltage $V_{sweep}$ is coupled to point C through a capacitor, and the voltage at point C is uniformly pulled down. When the level voltage at point C reaches the opening voltage of the first transistor T7 (i.e., threshold voltage $V_{th}$), the second voltage $V_{gh2}$ of the signal line gh2 is written in point E, thereby enabling the second driving transistor T3 to be conducted. At this time, a path from the power line VDD to the low potential power line VSS is conducted, and the light-emitting element LED emits light. It is assumed that the slope of uniformly decreased $V_{sweep}$ is K, and the total duration in the emitting-light stage is T0, such that the emitting-light duration is $T0-[(V_{gh2}+V_{th}+V_a)-V_{th}]/K$. At this time, the emitting-light duration is not only related to K, but also to voltage $V_a$.

Therefore, in some embodiments, the voltage $V_a$ may be compensated by control signal line a to implement pulse width modulation.

In other embodiments, when the first transistor T7 is an N-type transistor, the swing voltage $V_{sweep}$ is a uniformly rising voltage, and the emitting-light duration of the light-emitting element LED is also related to the slope of the swing voltage $V_{sweep}$. An analysis process may refer to the above embodiments and does not repeat here.

In some embodiments, at the end of the light-emitting stage, the first switch transistor T1 is broken by the switch control line EM, thereby enabling the light-emitting element LED to be broken.

Figure 9:
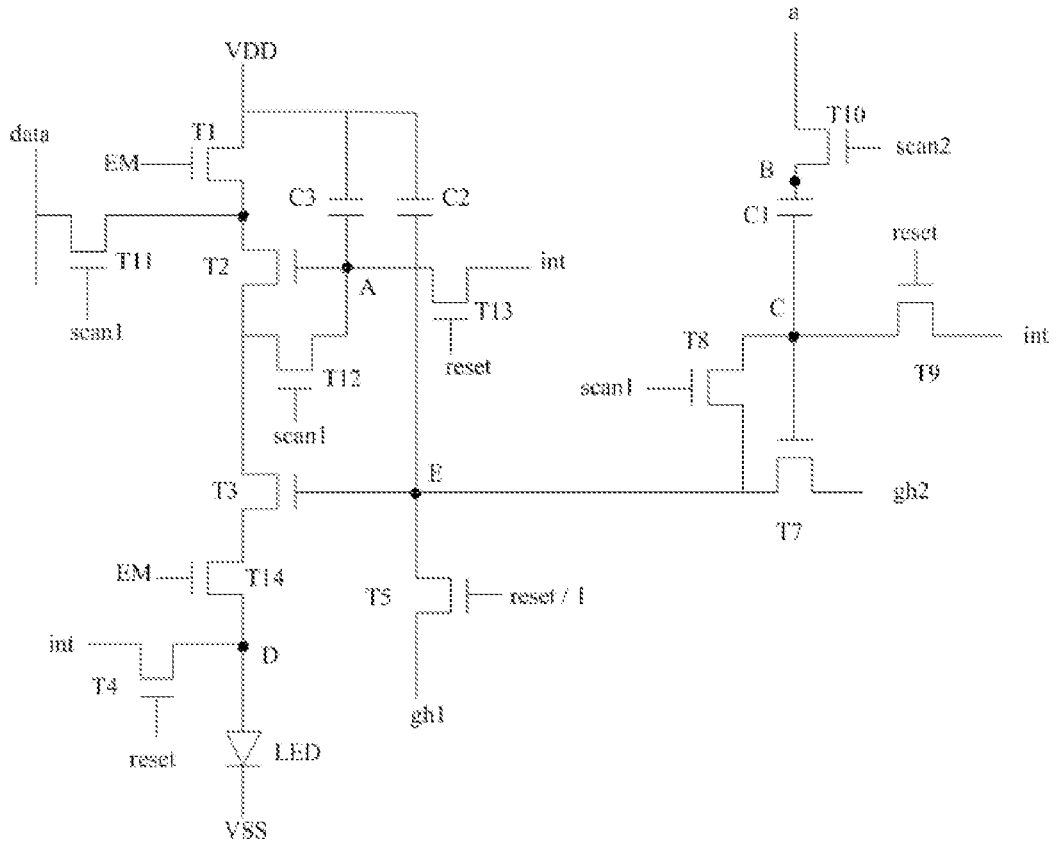
FIG. 9 is a structural schematic diagram of a second embodiment of a pixel driving circuit of the present disclosure.

The present disclosure also provides a specific circuit structure of a second pixel driving circuit, as shown in FIG. 9. FIG. 9 is a structural schematic diagram of a second embodiment of a pixel driving circuit of the present disclosure. As shown in FIG. 9, the control circuit includes a second switch transistor T14. A source of the second switch transistor T14 connected to the drain of the second driving transistor T3, a drain of the second switch transistor T14 is connected to the light-emitting element LED, and a gate of the second switch transistor T14 is connected to the switch control line EM. In some embodiments, the second switch transistor T14 may replace the switch transistor T6, which means that in the second embodiment, removing the switch transistor T6 may also implement control of a light-emitting period of the light-emitting element LED.

In some embodiments, the pulse width modulation unit PWM includes the second driving transistor T3, the first reset transistor T5, the first transistor T7, the second transistor T8, the third transistor T9, the fourth transistor T10, and the first capacitor C1.

The source of the first transistor T7 is connected to the signal line gh2, the drain of the first transistor T7 is connected to the drain of the second transistor T8 and the drain of the first reset transistor T5, and the gate of the first transistor T7 is connected to the first electrode plate of the first capacitor C1 and the source of the second transistor T8.

The source of the second transistor T8 is connected to the first electrode plate of the first capacitor C1 and the drain of the third transistor T9. The drain of the second transistor T8 is connected to the drain of the first transistor T7 and the drain of the first reset transistor T5, and the gate of the second transistor T8 is connected to the first scan control line scan1.

The source of the third transistor T9 is connected to the reset signal line int. The drain of the third transistor T9 is connected to the first electrode plate of the first capacitor C1, the gate of the first transistor T7, and the source of the second transistor T8. The gate of the third transistor T9 is connected to the reset control line reset The first electrode plate of the first capacitor C1 is connected to the gate of the first transistor T7, the source of the second transistor T8, and the drain of the third transistor T9. The second electrode plate is connected to the drain of the fourth transistor T10.

The source of the fourth transistor T10 is connected to the control signal line a, the drain of the fourth transistor T10 is connected to the second electrode plate of the first capacitor C1, and the gate of the fourth transistor T10 is connected to the second scan control line scan2.

The pulse width modulation unit PWM also includes the second capacitor C2. The first electrode plate of the second capacitor C2 connected to the power line VDD. The second electrode plate of the second capacitor C2 is connected to the gate of the second driving transistor T3, the drain of the first reset transistor T5. In this way, the voltage applied to the gate of the second driving transistor T3 may be maintained.

In the second embodiment, the pulse amplitude modulation unit PAM has the same structure as pulse amplitude modulation unit PAM in the first embodiment. In other embodiments, the pulse amplitude modulation unit PAM may also be other structure, for example, the gate of the first driving transistor T2 directly connected to the data line data, which is not limited here. In the second embodiment, the connection and arrangement of the first switch transistor T1 and the reset transistor T4 are the same as that of the first switch transistor T1 and the reset transistor T4 in the first embodiment, and is not repeated here.

In some embodiments, the gate of the first reset transistor T5 may be connected to the reset control line reset or the control line 1. The control line 1 controls the conduction of the first reset transistor T5 in the first, second, third, or fourth stage, and charges the gate of the second driving transistor T3 to enable the gate voltage of the second driving transistor T3 to be $V_{gh1}$ before emitting light, so that the voltage at point E in the emitting-light stage changes from $V_{gh1}$ to $V_{gh2}$ and remains unchanged. In other embodiments, the first reset transistor T5 may not be arranged, that is, the gate voltage of the second driving transistor T3 changes from unknown voltage to $V_{gh2}$ and remains unchanged until the light-emitting element LED ends emitting light. However, since the unknown voltage may enable the second driving transistor T3 to be in an on-state, the first reset transistor T5 being not arranged enable the gate voltage of the second driving transistor T3 to be in an uncontrollable stage.

Figure 10:
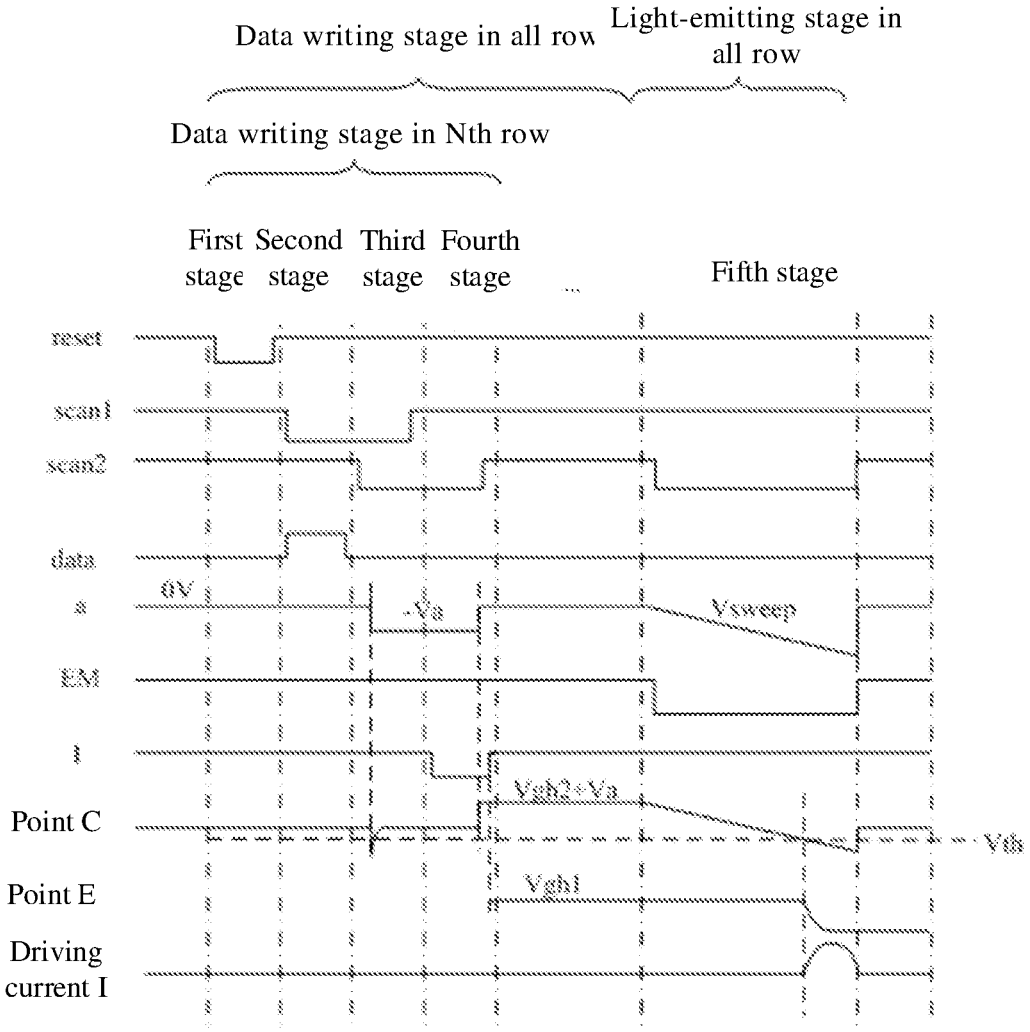
FIG. 10 is a driving signal time sequence diagram of a second driving method for pixel driving circuit according to some embodiments of the present disclosure.

In the second embodiment, the time sequence control signal of transistors is the same as that of transistors in the first embodiment. Specifically, referring to FIG. 10, FIG. 10 is a driving signal time sequence diagram of a second driving method for pixel driving circuit according to some embodiments of the present disclosure. The conduction situation of some transistors is the same as that of some transistors in the first embodiment, which is not repeated here.

In the present disclosure, the pulse width modulation unit PWM pre-charges point C by controlling the fourth transistor T10 and the third transistor T9. That is, the pulse width modulation unit PWM controls the initial voltage of the gate of the first transistor T7, and then applies to gradually reduced voltage to the first transistor T7 through T10 until the gate voltage of the first transistor T7 is less than the threshold voltage $V_{th}$, thereby enabling the first transistor T7 to be conducted. In this way, an unchanged second voltage $V_{gh2}$ is applied to the second driving transistor T3 through the signal line gh2, thereby enabling the second driving transistor T3 to be conducted by the unchanged voltage $V_{gh2}$. In case where the control units are all conducted, the power line VDD and the light-emitting element LED forms a path, thereby enabling the LED to start emitting light. When the switch control line EM of the first switch transistor T1 and/or the second switch transistor T14 of the control unit in the present disclosure returns to the initial level signal, the first switch transistor T1 and/or the second switch transistor T14 broken, and the light-emitting element LED ends emitting light. Specifically, in the first embodiment, the light-emitting element LED ends emitting light when the first switch transistor T1 is broken. In the second embodiment, when both the first switch transistor T1 and the second switch transistor T14 are broken, the light-emitting element LED ends emitting light.

In embodiments of the present disclosure, the pulse width modulation unit PAM and the switch transistors are matched to control the start and end of the light emission of the light-emitting element LED, thereby controlling the light-emitting duration of the light-emitting element LED. The starting time of light emission is controlled by the swing voltage of the control signal line and the slope of the swing voltage.

Figure 11:
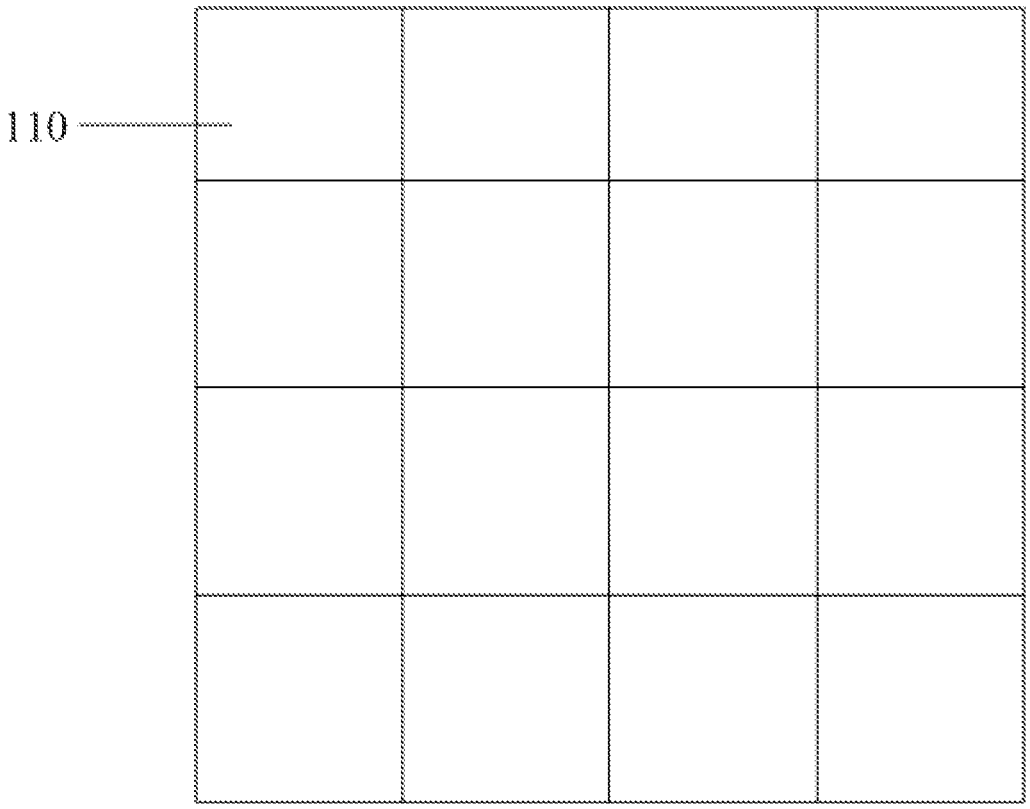
FIG. 11 is a structural schematic diagram of an embodiment of a display panel of the present disclosure.

The present disclosure also provides a display panel including a plurality of pixel units arranged in an array, and each pixel unit is provided with the pixel driving circuits in any of the above embodiments. Specifically, referring to FIG. 11, FIG. 11 is a structural schematic diagram of an embodiment of a display panel of the present disclosure. As shown in FIG. 11, the display panel includes a plurality of pixel units 110, each of which is provided with a pixel driving circuit.

The technical effect of the present disclosure is as following. PAM modulation and PWM modulation of the light-emitting elements are implemented in the display panel through 13 TFTs, 3 capacitors C, and a plurality of control lines.

The above are only embodiments of the present disclosure and are not intended to limit the scope of the present disclosure. Any equivalent structure or equivalent process transformation made using the description and accompanying drawings of the present disclosure, or directly or indirectly applied in other related technical fields, are included in the scope of the present disclosure.

What is claimed is:

1. A pixel driving circuit, comprising:

a light-emitting element;

a power line, connected to the light-emitting element;

a pulse amplitude modulation unit, comprising a first driving transistor connected to the light-emitting element and the power line, and configured to provide driving current with different amplitudes to the light-emitting element according to voltage applied to a gate of the first driving transistor; and a pulse width modulation unit, comprising:

a second driving transistor, connected to the light-emitting element and the pulse amplitude modulation unit;

a first transistor and a second transistor, connected to a gate of the second driving transistor; and a pulse width generation circuit, connected to the gate of the first transistor;

wherein a source of the first transistor is connected to a signal line, a drain of the first transistor is connected to a gate of the second driving transistor, and the gate of the first transistor is connected to the pulse width generation circuit; a source of the second transistor is connected to the gate of the first transistor, a drain of the second transistor is connected to the drain of the first transistor and the gate of the second driving transistor, and a gate of the second transistor is connected to a first scan control line;

wherein the pulse width generation circuit comprises a third transistor, a fourth transistor, and a first capacitor; a source of the third transistor is connected to a reset signal line, a drain of the third transistor is connected to a first electrode plate of the first capacitor and the gate of the first transistor, and the gate of the third transistor is connected to a reset control line; the first electrode plate of the first capacitor is respectively connected to the source of the second transistor, the drain of the third transistor, and the gate of the first transistor; a second electrode plate of the first capacitor is connected to a drain of the fourth transistor; a source of the fourth transistor is connected to a control signal line, the drain of the fourth transistor is connected to the second electrode plate of the first capacitor, and the gate of the fourth transistor is connected to a second scan control line;

wherein the control signal line provides a swing voltage to the first capacitor through the fourth transistor;

wherein duration of driving current in the light-emitting element is controlled by controlling the conduction duration of the second driving transistor according to the first transistor, the second transistor, and the pulse width generation circuit.

2. The pixel driving circuit as claimed in claim 1, wherein the pulse width modulation unit further comprises a first reset transistor and a switch transistor;

a source of the first reset transistor is connected to a first signal line, a drain of the first reset transistor is connected to the gate of the second driving transistor, and a gate of the first reset transistor is connected to the reset control line;

a source of the switch transistor is connected to the drain of the first transistor, a drain of the switch transistor is connected to the gate of the second driving transistor and the drain of the first reset transistor, and a gate of the switch transistor is connected to a switch control line.

3. The pixel driving circuit as claimed in claim 1, wherein the pulse width modulation unit further comprises a second capacitor;

a first electrode plate of the second capacitor is connected to the power line, and a second electrode plate of the second capacitor is connected to the gate of the second driving transistor, so as to maintain gate voltage of the second driving transistor.

4. The pixel driving circuit as claimed in claim 1, wherein the pulse amplitude modulation unit further comprises a fifth transistor, a sixth transistor, a second reset transistor, and a third capacitor;

a first electrode plate of the third capacitor is connected to the power line, and a second electrode plate of the third capacitor is connected to the gate of the first driving transistor, so as to maintain the gate voltage of the first driving transistor;

a source of the fifth transistor is connected to a data line, a drain of the fifth transistor is connected to the source of the first driving transistor, and the gate of the fifth transistor is connected to the first scan control line;

a source of the sixth transistor is connected to the drain of the first driving transistor, a drain of the sixth transistor is connected to the gate of the first driving transistor and the second electrode plate of the third capacitor, and gate of the sixth transistor is connected to the first scan control line;

a source of the second reset transistor is connected to the reset signal line, the drain of the second reset transistor is connected to a gate of the first driving transistor and a second electrode plate of the third capacitor, and the gate of the second reset transistor is connected to the reset control line.

5. The pixel driving circuit as claimed in claim 1, further comprising:

a control unit, connected to the light-emitting element and the power line, and configured to control on/off of the light-emitting element.

6. The pixel driving circuit as claimed in claim 5, wherein the control unit comprises:

a first switch transistor;

a source of the first switch transistor is connected to the power line, a drain of the first switch transistor is connected to the source of the first driving transistor, and the gate of the first switch transistor is connected to a switch control line.

7. The pixel driving circuit as claimed in claim 5, wherein the control unit further comprises a second switch transistor;

a source of the second switch transistor is connected to the drain of the second driving transistor, a drain of the second switch transistor is connected to the light-emitting element, and the gate of the second switch transistor is connected to a switch control line.

8. The pixel driving circuit as claimed in claim 1, further comprising:

a reset circuit, wherein the reset circuit is connected to an anode of the light-emitting element, so that the anode of the light-emitting element has same level voltage before emitting light each time.

9. The pixel driving circuit as claimed in claim 8, wherein the reset circuit comprises a reset transistor;

a source of the reset transistor is connected to the reset signal line, a drain of the reset transistor is connected to the anode of the light-emitting element, and a gate of the reset transistor is connected to the reset control line.

10. The pixel driving circuit as claimed in claim 1, wherein the first driving transistor, the second driving transistor, the first transistor, the second transistor, the third transistor, and the fourth transistor are at least one of P-type transistors and N-type transistors.

11. A driving method for the pixel driving circuit, wherein the pixel driving circuit comprises: a light-emitting element; a power line, connected to the light-emitting element; a pulse amplitude modulation unit, comprising a first driving transistor connected to the light-emitting element and the power line, and configured to provide driving current with different amplitudes to the light-emitting element according to voltage applied to a gate of the first driving transistor; and a pulse width modulation unit, comprising: a second driving transistor, connected to the light-emitting element and the pulse amplitude modulation unit; a first transistor and a second transistor, connected to a gate of the second driving transistor; and a pulse width generation circuit, connected to the gate of the first transistor; wherein a source of the first transistor is connected to a signal line, a drain of the first transistor is connected to a gate of the second driving transistor, and the gate of the first transistor is connected to the pulse width generation circuit; a source of the second transistor is connected to the gate of the first transistor, a drain of the second transistor is connected to the drain of the first transistor and the gate of the second driving transistor, and a gate of the second transistor is connected to a first scan control line; wherein the pulse width generation circuit comprises a third transistor, a fourth transistor, and a first capacitor; a source of the third transistor is connected to a reset signal line, a drain of the third transistor is connected to a first electrode plate of the first capacitor and the gate of the first transistor, and the gate of the third transistor is connected to a reset control line; the first electrode plate of the first capacitor is respectively connected to the source of the second transistor, the drain of the third transistor, and the gate of the first transistor; a second electrode plate of the first capacitor is connected to a drain of the fourth transistor; a source of the fourth transistor is connected to a control signal line, the drain of the fourth transistor is connected to the second electrode plate of the first capacitor, and the gate of the fourth transistor is connected to a second scan control line; wherein duration of driving current in the light-emitting element is controlled by controlling the conduction duration of the second driving transistor according to the first transistor, the second transistor, and the pulse width generation circuit; wherein the pulse width modulation unit further comprises a first reset transistor, a switch transistor, and a second capacitor; a source of the first reset transistor is connected to a first signal line, a drain of the first reset transistor is connected to the gate of the second driving transistor, and a gate of the first reset transistor is connected to the reset control line; a source of the switch transistor is connected to the drain of the first transistor, a drain of the switch transistor is connected to the gate of the second driving transistor and the drain of the first reset transistor, and a gate of the switch transistor is connected to a switch control line; a first electrode plate of the second capacitor is connected to the power line, and a second electrode plate of the second capacitor is connected to the gate of the second driving transistor, so as to maintain gate voltage of the second driving transistor; the pulse amplitude modulation unit further comprises a fifth transistor, a sixth transistor, a second reset transistor, and a third capacitor; a first electrode plate of the third capacitor is connected to the power line, and a second electrode plate of the third capacitor is connected to the gate of the first driving transistor, so as to maintain the gate voltage of the first driving transistor; a source of the fifth transistor is connected to a data line, a drain of the fifth transistor is connected to the source of the first driving transistor, and the gate of the fifth transistor is connected to the first scan control line; a source of the sixth transistor is connected to the drain of the first driving transistor, a drain of the sixth transistor is connected to the gate of the first driving transistor, and the second electrode plate of the third capacitor, and gate of the sixth transistor is connected to the first scan control line; a source of the second reset transistor is connected to the reset signal line, the drain of the second reset transistor is connected to a gate of the first driving transistor and a second electrode plate of the third capacitor, and the gate of the second reset transistor is connected to the reset control line; wherein the driving method comprises: in a first stage, the reset control line in a Nth row controls conduction of the third transistor and the second reset transistor, and reset voltage of the reset signal line is transmitted to the gate of the first transistor through the third transistor, and is transmitted to the gate of the first driving transistor through the second reset transistor, so as to enable the first transistor and the first driving transistor to be in an on-state; in a second stage, the first scan control line in the Nth row controls conduction of the second transistor, and second voltage of the signal line is transmitted to the gate of the first transistor through the first transistor and the second transistor to charge the gate of the first transistor; the first scan control line in the Nth row controls conduction of the fifth transistor and the sixth transistor, and data voltage of the data line is transmitted to the gate of the first driving transistor through the fifth transistor, the first driving transistor, and the sixth transistor in order, so as to charge the gate of the first driving transistor; in a third stage, the second scan control line in the Nth row controls conduction of the fourth transistor, and first level voltage of the control signal line is written in the second electrode plate of the first capacitor through the fourth transistor, and transmitted to the gate of the first transistor through coupling effect of the first capacitor; at the same time, the first scan control line controls conduction of the second transistor, thereby enable the gate and drain of the first transistor to be connected to each other to maintain gate voltage of the first transistor; in a fourth stage, the reset control line in the Nth row controls conduction of the first reset transistor, and first voltage of the first signal line is transmitted to the gate of the second driving transistor and the second electrode plate of the second capacitor through the first reset transistor, and is maintained through the second capacitor; the second scan control line in the Nth row controls conduction of the fourth transistor, and the second level voltage of the control signal line is written in the second electrode plate of the first capacitor through the fourth transistor, and transmitted to the gate of the first transistor through the coupling effect of the first capacitor to implement writing of width data; in a fifth stage, the second scan control line in all rows controls conduction of the fourth transistor, and swing voltage of the control signal line is transmitted to the gate of the first transistor through the fourth transistor and the first capacitor to control conduction of the first transistor; at the same time, the switch control lines in all rows control conduction of the switch transistor, and the second voltage of the signal line is transmitted to the gate of the second driving transistor through the first transistor and the switch transistor to control conduction of the second driving transistor.

12. The driving method as claimed in claim 11, wherein the first transistor is a P-type transistor, the swing voltage is uniformly decreasing voltage, and the light-emitting duration of the light-emitting element is related to a slope of the swing voltage.

13. The driving method as claimed in claim 11, wherein the second transistor is an N-type transistor, and the swing voltage is uniformly rising voltage.

14. The driving method as claimed in claim 11, wherein in the first stage, the first reset transistor is controlled to be conducted, and the first voltage of the first signal line is transmitted to the gate of the second driving transistor and the second electrode plate of the second capacitor through the first reset transistor, and is maintained through the second capacitor, so as to enable the second driving transistor to be in an off-state.

15. The driving method as claimed in claim 11, wherein the pixel driving circuit further comprises a control unit comprising a first switch transistor and/or a second switch transistor;

a source of the first switch transistor is connected to the power line, a drain of the first switch transistor is connected to the source of the first driving transistor, and a gate of the first switch transistor is connected to a switch control line; a source of the second switch transistor is connected to the drain of the second driving transistor, a drain of the second switch transistor is connected to the light-emitting element, and a gate of the second switch transistor is connected to the switch control line;

in the fifth stage, the switch control line is configured to control conduction of the first switch transistor and/or the second switch transistor, so as to form a path between the power line and the light-emitting element and enable the light-emitting element to emit light.

16. The driving method as claimed in claim 11, wherein the pixel driving circuit comprises a reset circuit comprising a reset transistor; a source of the reset transistor is connected to the reset signal line, a drain of the reset transistor is connected to the anode of the light-emitting element, and a gate of the reset transistor is connected to the reset control line;

in the first stage, the reset control line in the Nth row controls conduction of the reset transistor, and reset voltage of the reset signal line is transmitted to the anode of the light-emitting element through the reset transistor to restore anode voltage of the light-emitting element to level voltage.

17. A display panel, comprising a plurality of pixel units arranged in an array, and each pixel unit being provided with a pixel driving circuit comprising: a light-emitting element; a power line, connected to the light-emitting element; a pulse amplitude modulation unit, comprising a first driving transistor connected to the light-emitting element and the power line, and configured to provide driving current with different amplitudes to the light-emitting element according to voltage applied to a gate of the first driving transistor; and a pulse width modulation unit, comprising: a second driving transistor, connected to the light-emitting element and the pulse amplitude modulation unit; a first transistor and a second transistor, connected to a gate of the second driving transistor; and a pulse width generation circuit, connected to the gate of the first transistor; wherein a source of the first transistor is connected to a signal line, a drain of the first transistor is connected to a gate of the second driving transistor, and the gate of the first transistor is connected to the pulse width generation circuit; the source of the second transistor is connected to the gate of the first transistor, a drain of the second transistor is connected to the drain of the first transistor and the gate of the second driving transistor, and a gate of the second transistor is connected to a first scan control line; wherein the pulse width generation circuit comprises a third transistor, a fourth transistor, and a first capacitor; a source of the third transistor is connected to a reset signal line, a drain of the third transistor is connected to a first electrode plate of the first capacitor and the gate of the first transistor, and the gate of the third transistor is connected to a reset control line; the first electrode plate of the first capacitor is respectively connected to the source of the second transistor, the drain of the third transistor, and the gate of the first transistor; a second electrode plate of the first capacitor is connected to a drain of the fourth transistor; a source of the fourth transistor is connected to a control signal line, the drain of the fourth transistor is connected to the second electrode plate of the first capacitor, and the gate of the fourth transistor is connected to a second scan control line; wherein the control signal line provides a swing voltage to the first capacitor through the fourth transistor;

wherein duration of driving current in the light-emitting element is controlled by controlling the conduction duration of the second driving transistor according to the first transistor, the second transistor, and the pulse width generation circuit.

18. The display panel as claimed in claim 17, wherein the pulse width modulation unit further comprises a first reset transistor and a switch transistor;

a source of the first reset transistor is connected to a first signal line, a drain of the first reset transistor is connected to the gate of the second driving transistor, and a gate of the first reset transistor is connected to the reset control line;

a source of the switch transistor is connected to the drain of the first transistor, a drain of the switch transistor is connected to the gate of the second driving transistor and the drain of the first reset transistor, and a gate of the switch transistor is connected to a switch control line.

19. The display panel as claimed in claim 17, wherein the pulse width modulation unit further comprises a second capacitor;

a first electrode plate of the second capacitor is connected to the power line, and a second electrode plate of the second capacitor is connected to the gate of the second driving transistor, so as to maintain gate voltage of the second driving transistor.

20. The display panel as claimed in claim 17, wherein the pulse amplitude modulation unit further comprises a fifth transistor, a sixth transistor, a second reset transistor, and a third capacitor;

a first electrode plate of the third capacitor is connected to the power line, and a second electrode plate of the third capacitor is connected to the gate of the first driving transistor, so as to maintain the gate voltage of the first driving transistor;

a source of the fifth transistor is connected to a data line, a drain of the fifth transistor is connected to the source of the first driving transistor, and the gate of the fifth transistor is connected to the first scan control line;

a source of the sixth transistor is connected to the drain of the first driving transistor, a drain of the sixth transistor is connected to the gate of the first driving transistor and the second electrode plate of the third capacitor, and gate of the sixth transistor is connected to the first scan control line;

a source of the second reset transistor is connected to the reset signal line, the drain of the second reset transistor is connected to a gate of the first driving transistor and a second electrode plate of the third capacitor, and the gate of the second reset transistor is connected to the reset control line.

* * * * *